US008003877B2

(12) United States Patent
Elion

(10) Patent No.: US 8,003,877 B2
(45) Date of Patent: Aug. 23, 2011

(54) ELECTRONIC FINGERBOARD FOR STRINGED INSTRUMENT

(76) Inventor: Clifford S. Elion, Chatsworth, CA (US)

( * ) Notice: Subject to any disclaimer, the term of this patent is extended or adjusted under 35 U.S.C. 154(b) by 55 days.

(21) Appl. No.: 12/284,953

(22) Filed: Sep. 26, 2008

(65) Prior Publication Data

US 2009/0100992 A1 Apr. 23, 2009

Related U.S. Application Data

(60) Provisional application No. 60/976,413, filed on Sep. 29, 2007, provisional application No. 61/011,259, filed on Jan. 16, 2008.

(51) Int. Cl.
*G10H 1/18* (2006.01)

(52) U.S. Cl. ..... 84/646

(58) Field of Classification Search ..... 84/646
See application file for complete search history.

(56) References Cited

U.S. PATENT DOCUMENTS

| | | | | |
|---|---|---|---|---|
| 3,742,114 | A | 6/1973 | Barkan | |
| 4,079,651 | A * | 3/1978 | Matsui | 84/690 |
| 4,310,804 | A * | 1/1982 | Ryon | 331/1 A |
| 4,339,979 | A * | 7/1982 | Norman | 84/627 |
| 4,580,479 | A * | 4/1986 | Bonanno | 84/626 |
| 4,618,985 | A * | 10/1986 | Pfeiffer | 704/261 |
| 4,630,520 | A | 12/1986 | Bonanno | |
| 4,658,690 | A | 4/1987 | Aitken et al. | |
| 4,858,509 | A | 8/1989 | Marshall | |
| 4,951,546 | A * | 8/1990 | Takabayashi et al. | 84/718 |
| 5,398,585 | A | 3/1995 | Starr | |
| 2002/0005108 | A1 * | 1/2002 | Ludwig | 84/600 |
| 2004/0069607 | A1 * | 4/2004 | Hunter et al. | 200/512 |

OTHER PUBLICATIONS

Fletcher & Rossing, "The Physics of Musical Instruments", Springer-Verlang, 1998.

Hal Chamberlin Hayden, "Musical Applications of Microprocessors", 1985.

* cited by examiner

*Primary Examiner* — Jianchun Qin

(74) *Attorney, Agent, or Firm* — Colin P. Abrahams

(57) ABSTRACT

An electronic musical instrument for producing musical notes includes an onset signal sensor for sensing the initiation of a note played on the musical instrument. An electronic fingerboard determines the pitch of the note sensed by the sensor. The electronic fingerboard comprises a first layer of film, a second layer of film and a spacer member between the first and second layers of film. The first and second layers are movable relative to each other between a first inactive position in which the first and second layers are separate from each other along their respective lengths and a second active position in which the first and second layers are in contact with each other at a user selected point along their respective lengths. The pitch is determined by the resistance between the first and second layers at the user selected point.

25 Claims, 6 Drawing Sheets

ELECTRONIC FINGERBOARD FOR STRINGED INSTRUMENT

CROSS REFERENCE TO RELATED APPLICATIONS

This application claims the benefit of U.S. Provisional Patent Applications Nos. 60/976,413 filed Sep. 29, 2007 and 61/011,259 filed Jan. 16, 2008, both of which are incorporated by reference in their entirety.

FIELD AND BACKGROUND OF THE INVENTION

The present invention relates to an interface for controlling musical instrument synthesizers. In one aspect, the present invention allows musicians familiar with stringed instruments to use their musical skill to control electronic music synthesizers.

According to one aspect of the invention, there is provided a synthesizer controller based on a guitar interface, but the invention is not limited to use with guitars and can be utilized in any other stringed instrument form-factor.

A typical stringed instrument has two means for activating and controlling sounds. The first means controls the loudness or onset of the tone, and the second means controls the pitch of the tone. In a conventional mechanical or electro-mechanical stringed instrument, this is accomplished by strumming, plucking or bowing the strings with one hand to provide the onset and loudness. The fingers of the other hand are used to terminate the string length to define the pitch of the note.

Two types of interfaces for electronic stringed instruments are generally known. The first is based on pitch detection using an electromagnetic, piezo-electric or optical pickup coupled to each string. The pickup converts the string vibrations into an electrical signal and a combination of hardware signal conditioning and software algorithms is then used to convert the electronic signal into information that can be transmitted to a music synthesizer. This may typically be a MIDI (Musical Instrument Digital Interface) device. This method, however, is characterized by a physical delay between the time that the string is plucked and the time that the resulting note is generated. The delay is due to the fact that a significant part of the electrical waveform must be analyzed before a result can be calculated and transmitted. In a normal guitar, the low E string is about 82.4 Hz, so a single cycle of this waveform is 12.1 ms. Typical systems need to acquire more than a single cycle before the pitch can be accurately determined, and this can result in delays that are not pleasing to musicians.

The second method is based on a set of switches in the instrument neck combined with a set of triggers. The switches in the neck are used to define the pitch of the note to be played. The triggers are plucked or strummed and are used to activate the onset of the note. The problem with this type of system is that the switches in the neck are not very guitar-like for musicians familiar with conventional guitars as well as being expensive to implement.

SUMMARY OF THE INVENTION

In accordance with one aspect of the invention, there is provided an electronic musical instrument for producing musical notes comprising: an onset signal sensor for sensing the initiation of a note played on the musical instrument; and an electronic fingerboard for determining pitch of the note sensed by the sensor, the electronic fingerboard comprising a first layer of film, a second layer of film and a spacer member between the first and second layers of film, the first and second layers being movable relative to each other between a first inactive position in which the first and second layers are separate from each other along their respective lengths and a second active position in which the first and second layers are in contact with each other at a user selected point along their respective lengths, the pitch being determined by the resistance between the first and second layers at the user selected point.

Preferably, the onset signal sensor comprises a piezo-electric sensor, or an optical sensor.

In one embodiment, the musical instrument is a guitar; the fingerboard is mounted on an elongate neck; frets are formed transversely on the neck; elongate structures corresponding to guitar strings are configured on the neck; and a first layer, second layer and spacer member are formed below each of the elongate structures.

Preferably, the first layer is a conductive strip, and the second layer is a resistive strip. The conductive strip may be comprised of silver ink with carbon overlay for durability and the resistive strip may be comprised of carbon. In one form, the conductive strip is on top, the resistive strip is below the conductive strip and the spacer member is formed therebetween. In one embodiment, the conductive strip is comprised of two electrodes which interlock with each other.

In one aspect, the elongates structures corresponding to guitar strings comprise linear raised ribs on the on the fingerboard. Quantized mode, legato mode, or absolute mode may be utilized to determine the pitch of the note.

Preferably, the user selected point provides a controllable resistance representing pitch of the note according to the location of the point on the fingerboard. The onset signal sensor may be triggered by plucking a string on the musical instrument.

Preferably, a microprocessor is provided for sequentially reading and processing signals from the signal sensor and the electronic fingerboard respectively to determine when a note is played, as well as the volume and pitch of the note. The microprocessor may send data on the note played to a MIDI interface, or to an internal wavetable synthesizer.

Preferably, the first and second layers have a terminal at one end thereof and voltage at the terminal is determined by the user selected point. The voltage at the terminal may be proportional to the user selected point along the first and second layers, at which point the first and second layers are shorted together.

In one aspect, the first and second layers comprise a force sensing resistor whereby the resistance will vary as pressure on the user selected point changes, the higher the pressure on the user selected point causing more area contact between the first and second layers. Further, the measurement of a played note may be repeated a programmed number of times to determine an accurate pitch of played note.

In one embodiment, the fingerboard comprises multiple conductive electrode planes, each plane for detecting the pitch of a note at one or more predetermined locations on the fingerboard. Two alternating electrode planes, each of the two planes being responsive to the user selected point when located at alternating frets of the fingerboard, may be provided.

According to another aspect of the invention, there is provided an electronic musical instrument for producing musical notes comprising: an electronic fingerboard for determining pitch of the note, the electronic fingerboard comprising a first layer of film, a second layer of film and a spacer member between the first and second layers of film, the first and second layers being movable relative to each other between a first inactive position in which the first and second layers are separate from each other along their respective lengths and a second active position in which the first and second layers are in contact with each other at a user selected point along their respective lengths, the pitch being determined by the resistance between the first and second layers at the user selected point.

According to another aspect of the invention, there is provided a method of playing an electronic musical instrument which produces musical notes, the method comprising: activating an onset signal sensor for sensing the initiation of a note played on the musical instrument; and applying pressure to one or more user selected points on an electronic fingerboard which determines the pitch of the note sensed by the sensor, the electronic fingerboard comprising a first layer of film, a second layer of film and a spacer member between the first and second layers of film, the first and second layers being moved relative to each other between a first inactive position in which the first and second layers are separate from each other along their respective lengths and a second active position in which the first and second layers are in contact with each other at the user selected point along their respective lengths, the pitch being determined by the resistance between the first and second layers at the user selected point.

In accordance with one aspect of the present invention, the system of the invention is an improvement to and based upon the principles of the second type of interface described above using separate sensors for pitch and onset. The onset can be realized in many different ways using magnetic, piezo-electric, hall-effect, optical or other sensors. The pitch control means of the invention, instead of using a multitude of switches in the neck, utilizes technology which can generally be described as that adapted from the principles used in computer touch-screens using resistive technology. In one embodiment of the invention, resistive sensors are used to simulate the strings. The resistance generated by the sensors is proportional to the position along the length of the sensor at which it is activated by the user. The resistive sensors are read by an analog-to-digital converter that is controlled by a micro controller such that when the player presses on the sensor, the termination length determines the resistance read so that the represented note can be activated.

This system of the invention provides, in one form thereof, a mechanism that is familiar to guitar players and musicians skilled in playing any stringed instrument. Additionally, the resistive fingerboard of the invention can be enhanced with linear raised surfaces to provide tactile feedback giving the sensors on the instrument neck a similar feel to a conventional stringed instrument. The raised surfaces can be implemented or otherwise formed on the instrument with, as examples only, printing techniques, or by adding plastic ribs along the length of the sensors, or by embossing the raised shape on the sensor material, or adding an embossed overlay layer. The raised surfaces can be included to simulate the feel of the strings as well as the feel of the frets as necessary.

The system of the invention may have has the following benefits:

(1) Pitch Detection Method

The device of the present invention does not suffer from the inherent delay of pitch detection algorithms. The resistance value of the string sensor can be read instantaneously by the controlling microprocessor.

(2) Switch Method

This switch interface is not familiar to musicians who are trained to use stringed instruments. Pressing switches is a foreign experience and requires re-training. Therefore, one aspect of the present invention may provide a similar or familiar playing experience to that of conventional stringed instruments. Furthermore, there are cost benefits of the system of the invention, since it is simpler and efficient thus potentially costing less than that for a multi-switch system. Also the ability to provide mechanical ribs or rails emulates very closely a regular stringed instrument such as a guitar and therefore provides similar tactile feedback to a string for the player.

Another aspect of the present invention is that it may use a constant current source to excite the sensors resulting in a linear response from the sensors without the requirement for providing an electrical connection to both sides of the resistive strip. There are preferably only two conductors in the sensor, namely, the conductive strip and the resistive strip. The signal is measured directly at the termination of the resistive strip. This allows for a much simpler construction of the resistive sensor. The system is also preferably configured so that the conductive silver strip is physically located above a carbon strip. The conductive strip is connected to ground potential and thus also provides some shielding to reduce noise pickup in the system.

An instrument configured and constructed in accordance with the present invention is generally played much like a conventional guitar. Notes are fingered on the neck of the guitar and the string triggers can be plucked or strummed using common guitar playing techniques.

Several modes of operation of the present invention controlled by the micro controller may also be provided that can be used to enhance the musical performance. Representative examples of such modes are described below.

Examples of Modes of Operation

In quantized mode, the pitch is determined when the string trigger is activated. The pitch of the initial note transmitted is quantized to the closest real note (½ step) value. If the user then slides his finger along the fingerboard the adjacent note (½ step) corresponding to the new finger position will sound.

In legato mode, the pitch is determined when the string trigger is activated. The pitch of the initial note transmitted is quantized to the closest real note (½ step) value as in quantized mode. If the user then slides his finger along the fingerboard, the system will use pitch bend commands to modify the pitch of the note proportionally to the new position on the fingerboard relative to the initial onset position. This mode provides a mechanism of control similar to guitar pitch bend in which the strings are bent. This allows smooth transitions in note pitch value as well as the ability for the user to implement pitch vibrato by rocking his finger back and forth causing slight pitch modulations. This is not available in switch based systems.

In absolute mode, the pitch is determined when the string trigger is activated. The pitch of the initial note transmitted is sent according to the note+pitch bend matching the actual position of the finger on the fingerboard. This mode is more like a fretless instrument where the note sounding always corresponds to the absolute position on the fingerboard. Vibrato modulations as in the legato mode are also possible in absolute mode. This is not available in switch based systems.

Fingerboard Layout

The fingerboard layout shown in FIG. 1 is used in the present embodiment of the invention. It is scaled to substantially match the fingerboard of a conventional stringed electric guitar. Many other configurations and scales are envisioned and fall within the scope of the invention. On a conventional guitar neck, the frets are spaced proportionally to the pitch of the note generated by the fingerboard position. Due to the fact that this system is electronic, the scale can be varied so that the frets, or fret markings, can be evenly spaced on the neck and also made smaller to provide a more compact system. The translation of finger position to actual pitch generated is determined by the software using a look-up table, mathematical equation or similar means that can also be varied to accommodate tunings of different stringed musical instruments.

DETAILED DESCRIPTION OF THE INVENTION

Figure 1:
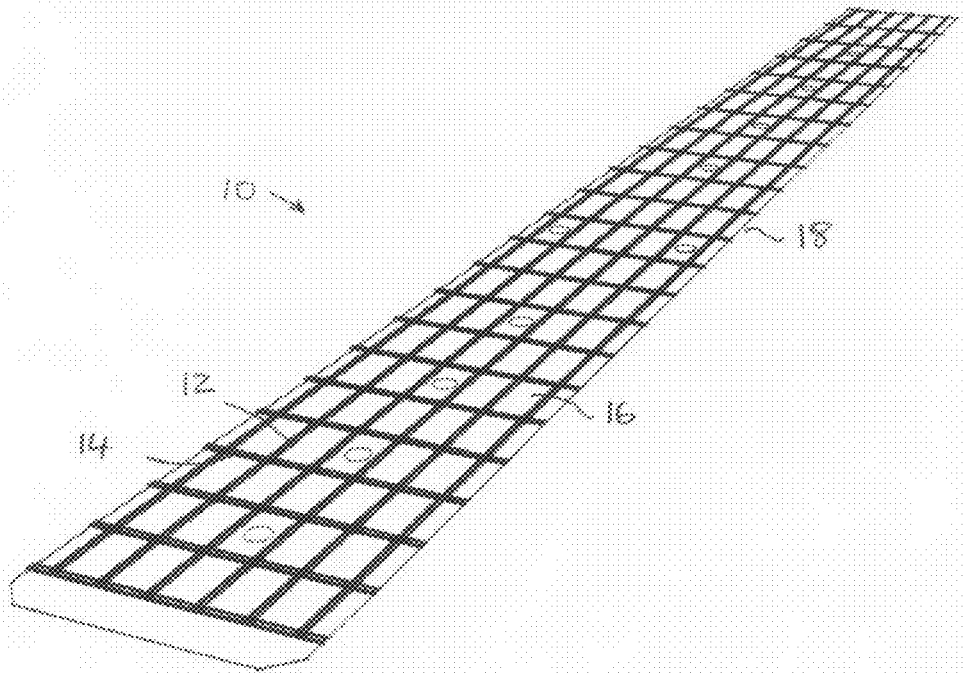
FIG. 1 is a perspective view of a typical fingerboard designed for guitar instruments.

FIG. 1 shows a conventional fingerboard assembly 10 for use with the system of the invention. In this illustrated embodiment, the top layer of the fingerboard assembly 10 has strings 12 and frets 14 that are embossed on the surface 16 of the fingerboard assembly 10, and these raised markers for the strings 12 and frets 14 provide tactile feedback to the user. The strings 12 and/or the frets 14 could be omitted from the design. The process of marking chosen for this embodiment is to emboss these features onto the top overlay or surface 16 of the fingerboard assembly 10. Other methods include silk-screening the features with durable epoxy based ink. In another embodiment, there is use of a k round plastic rib that is adhered along its flat end or surface along the length of the neck 18 to simulate the tactile feeling of a string 12.

Figure 2A:
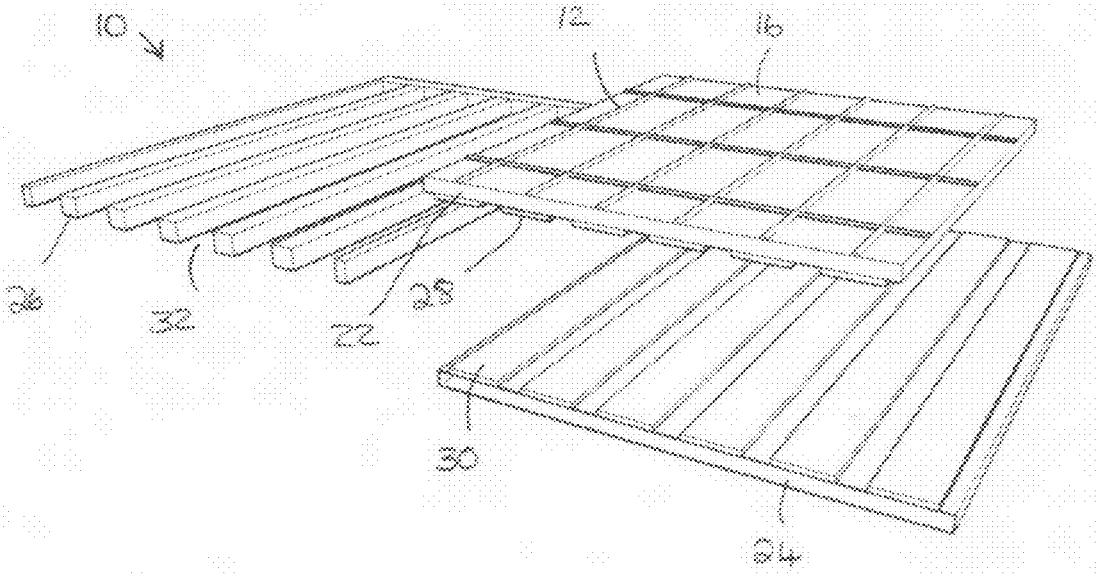
FIG. 2A is an enlarged cross section of the fingerboard shown in FIG. 1 of the drawings.
Figure 2B:
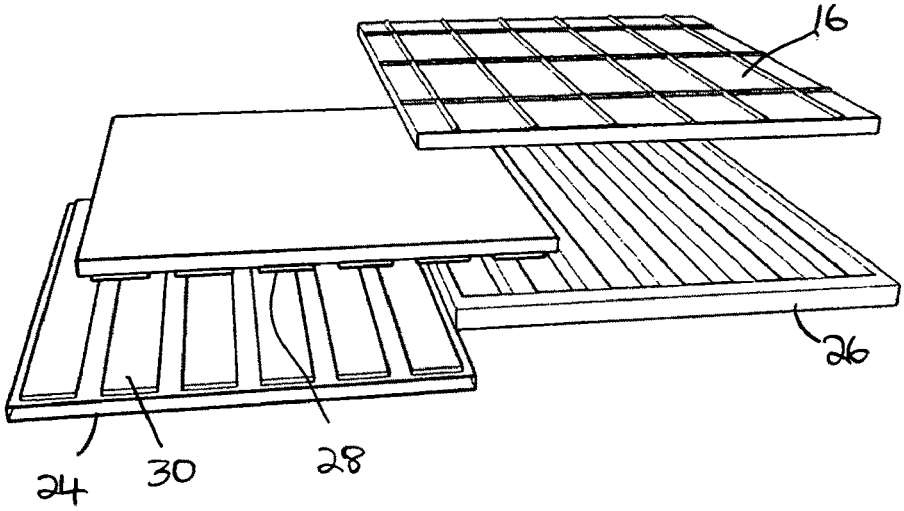
FIG. 2B is a further embodiment showing an enlarged cross section of the fingerboard shown in FIG. 1 of the drawings, but with the top section comprising two layers.

FIG. 2 of the drawings shows an exploded cross section of the fingerboard assembly 10 in accordance with the invention. There is provided a top polyester film 22 and a bottom 26 polyester film 24 which are separated by an adhesive spacer 26 layer. The top film 22 is coated with strips of silver conductive ink 28 along the length under each string 12 forming the ground electrode. The bottom film layer 24 is coated in strips of resistive carbon ink 30 forming the conductive electrode. The spacer 26 creates a series of gaps 32 between the silver conductive ink 28 and the resistive carbon ink 30 so that they do not come into contact with each other in the normal resting position. When the user touches any location along the line of a string 12, the carbon resistive ink 30 comes into contact with the silver conductive ink 28 causing the resistance to be terminated at a value proportional to the location at which the fingerboard is touched. This provides a controllable resistance that represents the pitch of the musical note corresponding to the location of the user's finger on the string.

Figure 3:
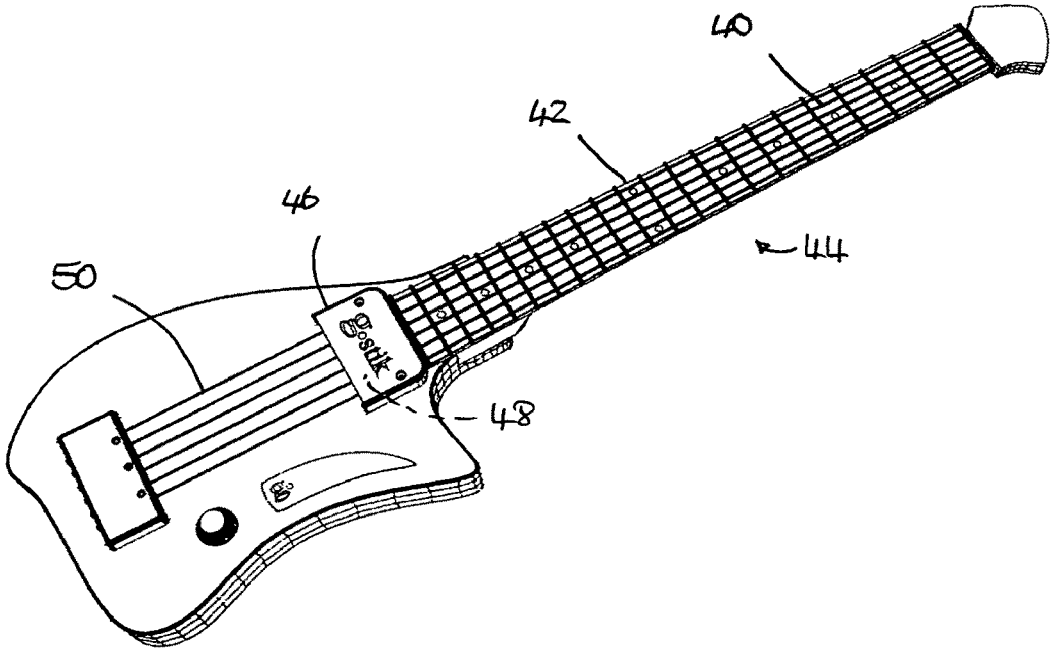
FIG. 3 is a perspective view of the complete guitar instrument.

FIG. 3 shows an overview of the present embodiment of the invention. The fingerboard 40 is located along the neck 42 of the instrument giving it the look and feel of a conventional guitar 44. Piezo sensors 48 are located in the bridge 46. These sensors 48 provide the onset signal to the control electronics. These are activated when the user strums or plucks the string triggers 50.

Figure 4:
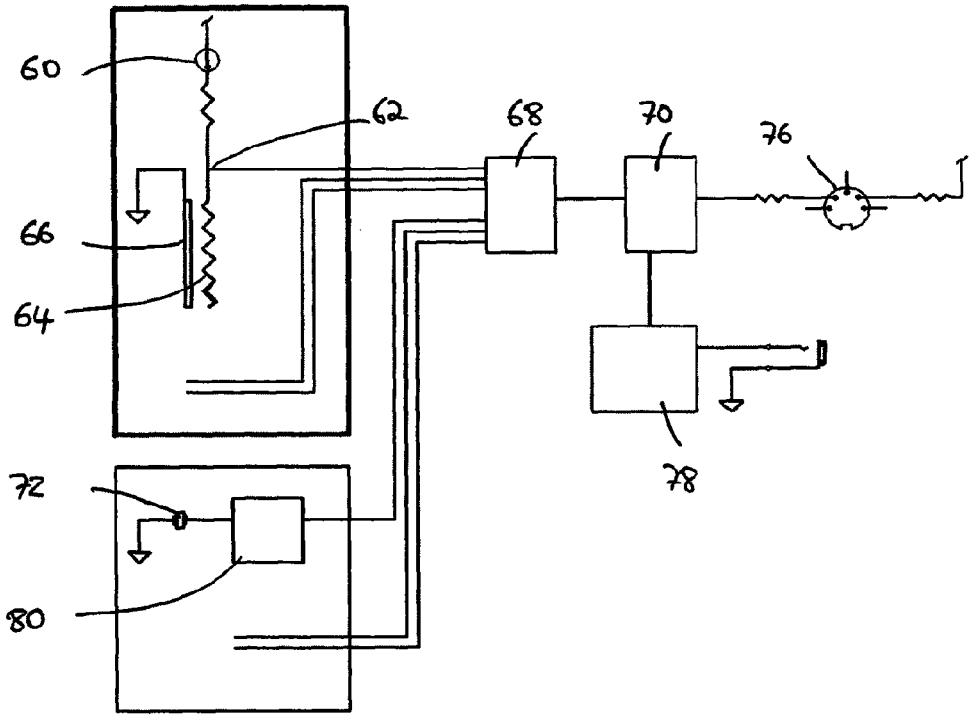
FIG. 4 is a circuit diagram of basic electronic circuitry which can be used in accordance with one embodiment of the present invention.

FIG. 4 of the drawings is a block diagram of the system electronics of the present invention. Each resistive strip 62 is powered by a constant current source 60, which ensures that the response of the resistive strip 62 is linear. The voltage at the terminal on the resistive strip 62 is determined by the location along the length of the carbon strip 62 that comes into contact with the silver ground strip 66. The signal from this point is conditioned and fed into a multiplexer 68 whose input selection is controlled by the microprocessor 70. The output of the piezo sensor elements 72 are also routed to the multiplexer 68. The microprocessor 70 sequentially reads the voltage values on the resistive strips 62 as well as the string triggers 80. This data is used to determine when a note is played, how loud the note is played and the pitch of the note played. Once the software decides on the note, it can optionally send this data out via the MIDI interface 76, or in this embodiment trigger a note in the built in internal wavetable synthesizer 78.

Figure 5:
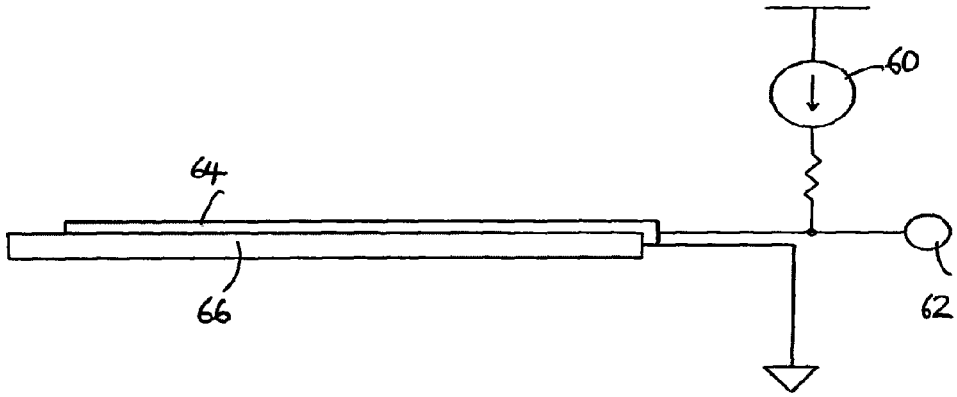
FIG. 5 is a schematic representation of the fingerboard electronics.

FIG. 5 of the drawings shows a schematic representation of the resistive sensor 90 as described in the above text for FIG. 4. This figure illustrates the mechanical construction in schematic form. It can be seen that the conductive strip 66 is connected to signal ground and the resistive strip 64 is connected to the current source and the terminal 62 is fed to the analog to digital converter. When there is no activation, the voltage at the terminal 62 is pulled up to the power supply voltage. As soon as the conductive strip 66 comes into contact with the resistive strip 64, a current flows through the resistive strip 64 between the terminal 62 and the point at which it is connected to ground. The voltage generated at the terminal 62 is thus proportional to the location along the length of the two strips 64 and 66 at which they are shorted together.

In one preferred embodiment of the invention, the fret spacing for stringed musical instruments may be determined to create evenly spaced musical half-steps along the length of the neck. The distance between frets uses the just musical scale which is proportional to the 12th root of 2. This requirement results in frets at the top of the neck being very wide or further apart and frets at the bottom of the neck being narrower or closer together.

In this design, there is no requirement for any particular fret spacing and it can be entirely controlled by the system software. In accordance with the present invention, fret spacing can be custom designed and configured so as to provide optimal comfort for the player as well as a familiar change from wider to narrower fret spacing.

Uniform spacing is also possible using the invention, but this may be quite uncomfortable for guitar players, partly because of the familiarity with traditional instrument spacing and partly because there is a natural tendency for the musician's hand to rotate as it moves along the length of the neck simply due to the mechanics of the human body. The present invention therefore provides for a spacing that is more ergonomic and "comfortable", and allows good access to all notes over the full scale of the neck.

In one embodiment of the invention, the difference between standard fret spacing and a constant fret spacing may be split using an equation developed for this purpose.

Figure 6:
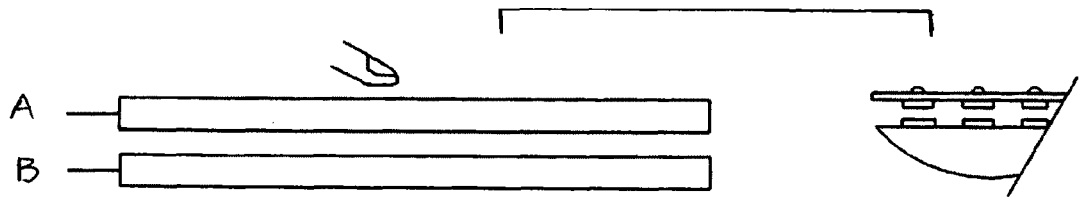
FIG. 6 is a diagrammatic representation showing pitch detection using the present invention.

With reference to FIG. 6 of the drawings, there is illustrated schematically pitch detection, effected by measuring the resistance between the upper (conductive) layer A and the lower (resistive) layer B. In FIG. 6, A represents the silver conductive strip, B represents the carbon resistive strip, the resistance representing the pitch measured between point A and point B.

Figure 7:
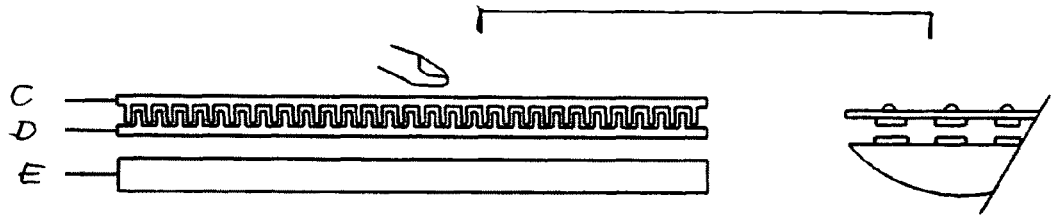
FIG. 7 is a diagrammatic representation showing pitch and pressure detection using the present invention.

In FIG. 7 of the drawings, C represents the first silver conductive strip, D represents the second silver conductive strip, while E represents the carbon resistive strip. The resistance represents the pitch measured between point C and E or D and E, and the resistance representing pressure is measured between point C and D. In FIG. 7, the pattern on the conductive silver layer is broken into two separate conductive electrodes. The electrodes have fingers that are interleaved. The resistance measurement for pitch is similar to that illustrated in FIG. 6 above. Essentially, the fact that there are two electrodes is ignored. The electronics is programmed to measure the resistance between C and E (or D and E) and in fact the measurement can even be done by shorting C and D together and measuring the resistance between the shorted silver electrodes and the carbon electrode (E).

The measurement for pressure is done by treating the device as a force sensing resistor. Point E is floated by the electronics and the measurement is done between electrodes C and D. This resistance will vary as the pressure of the user's finger causes more of the area of the electrodes to come into contact with the carbon electrode or strip E.

Figure 8:
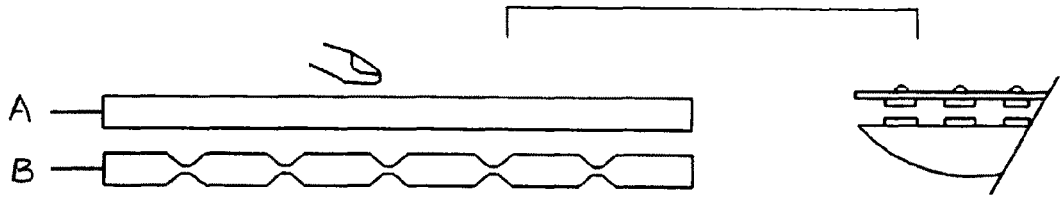
FIG. 8 is a diagrammatic representation showing stepped resistance using the present invention.

With referenced to FIG. 8 of the drawings, there is shown another embodiment of the system of the invention which utilizes a stepped shape in the resistive element. The steps occur coincidentally with the fret positions. Due to the smaller amount of resistive material deposited at the fret locations, the resistance change over these areas is much larger. This allows for greater discrimination between adjacent notes on the fingerboard.

One preferred response produced by the invention when changing from rest (no touch) to activated (touched) is that the measurement is instantaneous. In real situations, the measured value may vary slightly at the onset or release of the mechanism. Usually a simple quality measurement can be obtained by repeating the measurement and counting the number of repeated samples that fall within a pre-defined range. When the number of repeats is greater than a preset threshold, the measurement is determined to be valid. If the number of repeats could be made arbitrarily long, the system would always be accurate. For practical reasons the number of repeated samples must be limited so that the system responds in a timely fashion.

Error conditions may occur when the user does not keep constant pressure on the fingerboard. There are a few cases when this is particularly apparent:

(a) When a musician is holding a multi-note chord. Towards the end of the chord, the musician will start to reduce pressure on the fingerboard in a non-controlled manner.

(b) If a musician is playing very soft subtle notes, he may not apply good consistent pressure to the fingerboard.

Under these conditions the system may report an error, usually a lower measurement value than expected based on the fret position.

If an event is not executed by the player with precision, during the transitions as the fingerboard makes and breaks contact there can be measurements that are read as lower values than the desired value. This error is usually small, and typically is of a value that is within the range of −1 half-step (i.e. one fret lower).

To maintain a quick response to fingerboard changes, it may not be possible to increase the number of measurements for too long a period of time, so some other method of determining this error condition is needed.

Figure 9:
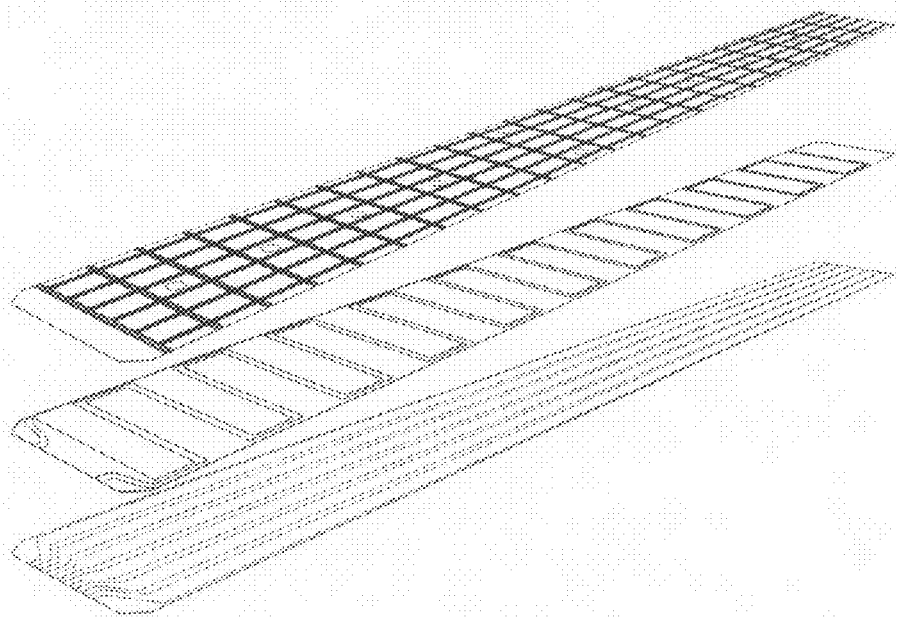
FIG. 9 is schematic perspective view of a fretboard in accordance with another aspect of the invention.
Figure 10:
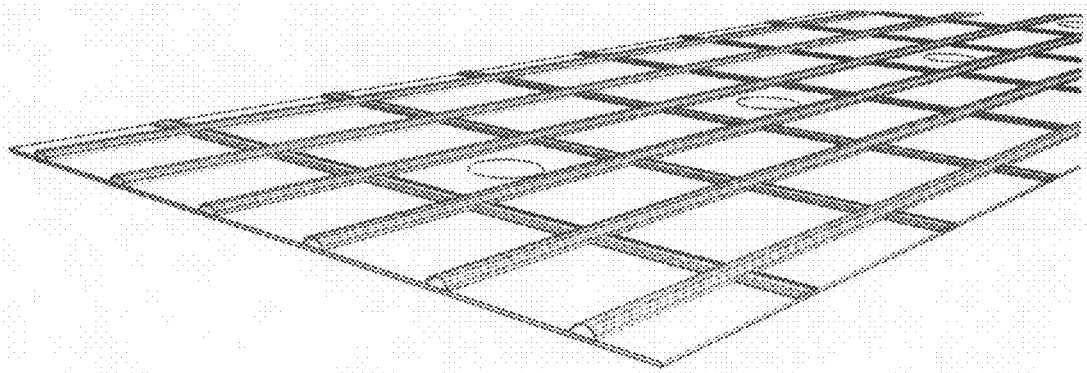
FIG. 10 is an enlarged perspective view of the top of the fingerboard showing strings in the form of raised half ribs.
Figure 11:
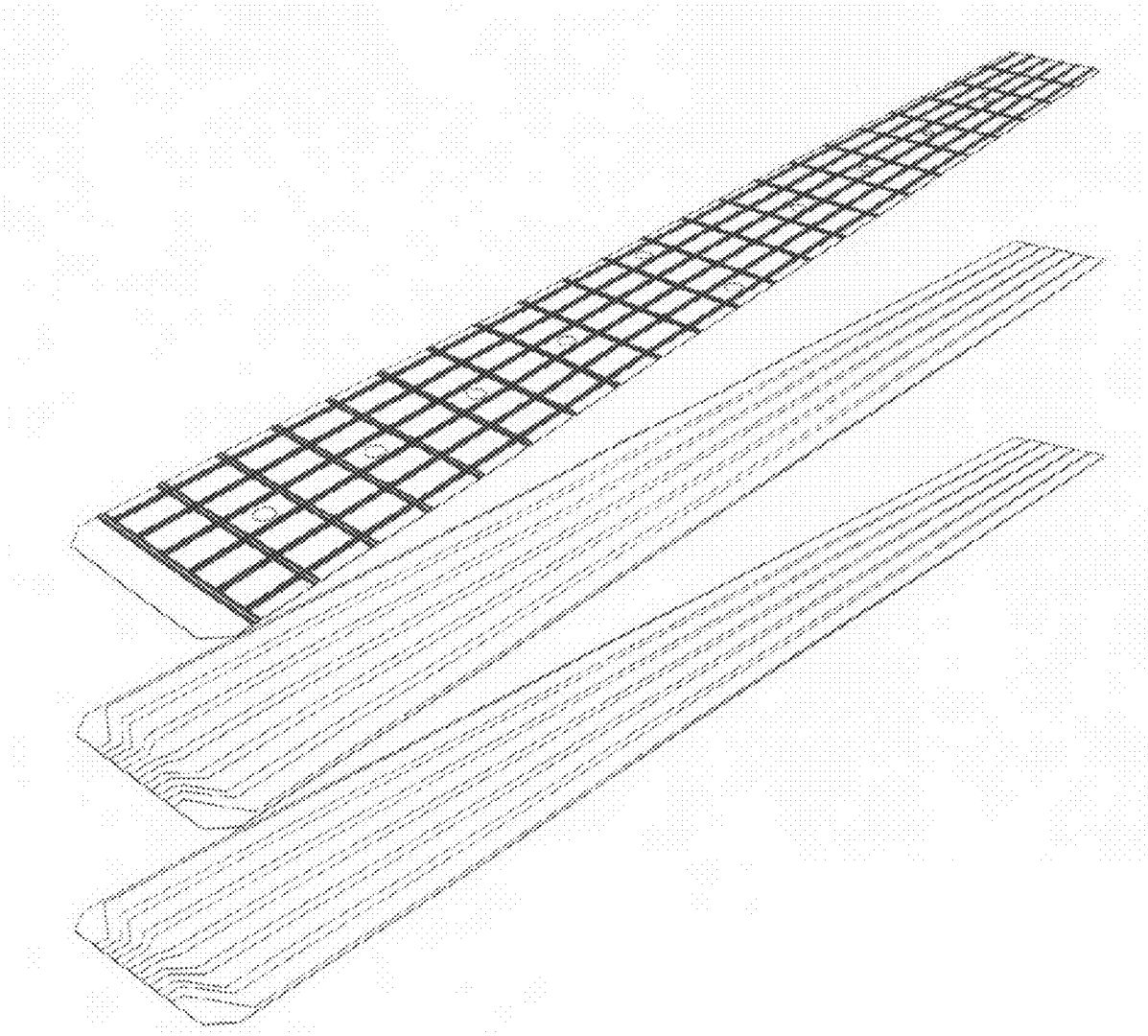
FIG. 11 is a view of the fingerboard of the invention as shown in FIG. 1 in an exploded view showing the various layer in accordance with the invention.

One solution to this situation is to configure the conductive electrode as multiple planes, effectively separating areas of the neck. For this example two separate planes are used as illustrated in FIG. 9 of the drawings. The two planes allow the separation of the scanning cycles into odd and even frets by alternately grounding and floating the planes. This allows the selective scanning of even and odd frets. When the user is pressing an even fret, say the $4^{th}$ fret, an erroneous measurement might report a note that corresponds to the $3^{rd}$ fret. However if the measurement is taken with the even plane activated, it will be known that this is an error.

The system can thus correct for these errors. For example, if one is scanning even frets and the resistance is reporting an odd fret (say $3^{rd}$ fret), it is recognized that this is an error and can safely substitute the measurement and note value that corresponds to the correct fret position ($4^{th}$ fret) for the onset of the note. The value can further be monitored by the system software as the value is corrected after the initial instability.

Note that this method can be extended for even further precision by 3, 4 or any other number of ground planes that are practical for the embodiment.

The system of the present invention is preferably based on conventional membrane switch manufacturing processes and simply has two layers (one conductor, one resistor) that are separated with an adhesive spacer. The spacer not only holds them together, but provides a consistent separation between the conductors allowing them to be activated when pressure is applied. There are no return or bridging conductors needed. All the signals are detected from the return end of the assembly.

In one form of the present invention, pressure is determined using the same set of conductors that are used to determine pitch. As such, the invention can be cost effective and thus designed for high-volume mass production. The system of the present invention can also provide individual pressure readings per string. It also uses the force sensing resistor pattern so as not to need an additional layer for pressure.

In one aspect, the invention describes an interface to MIDI synthesizer (using a conventional MIDI din jack, or USB interface to PC) or to a built in synthesizer.

The force sensing resistor pattern used in accordance with one aspect of the invention in the string sensor provides pressure sensitivity and also provides separate pressure per string. Other constructions only allow for a single pressure reading. Further, the construction of the present invention uses, in one embodiment, a separate embossed fingerboard overlaid on the switch mechanism.

The present invention is generally simple, and may use ink screening processes on two separate substrates that are assembled using an adhesive spacer. There are no "intervening conductor strips" that need to be folded, or any connecting portions. Each conductive or resistive strip is simply terminated in a connector at one end of the fingerboard where all measurements are made. As such, the present invention does not use a folded band and has signal returns at a single end of the sensor.

In one form, the invention uses piezo sensors and short strings for trigger inputs. Using a multiplexer is a standard electronic method and depends only on the hardware embodiment, namely, availability of analog to digital converter channels on the specific hardware chosen.

The invention provides for a pressure sensor based on the force sensing resistor pattern as described above. This does not require any additional layers or materials. A separate layer is used for the string tactile feeling. This may be less expensive and easier to manufacture. In one embodiment, the invention utilizes a polycarbonate overlay that is embossed with both the fret and string features. The "string-like" feel is improved with the implementation of fret features.

The invention claimed is:

1. An electronic musical instrument for producing musical notes comprising:

an onset signal sensor for sensing the initiation of a note played on the musical instrument, an electronic fingerboard having longitudinal strings and transverse frets formed by linear raised rib surfaces to provide tactile feedback and feel similar to a conventional stringed instrument, the electronic fingerboard determining pitch of the note sensed by the sensor, the electronic fingerboard comprising a first layer of film, a second separate layer of film and a spacer member between the first and second layers of film, the first and second layers being movable relative to each other between a first inactive position in which the first and second layers are separate from each other along their respective lengths and a second active position in which the first and second layers are in contact with each other at a user selected point along their respective lengths, the pitch being determined by the resistance between the first and second layers at the user selected point.

2. An electronic musical instrument as claimed in claim 1 wherein the onset signal sensor comprises a piezo-electric sensor.

3. An electronic musical instrument as claimed in claim 1 wherein the onset signal sensor comprises an optical sensor.

4. An electronic musical instrument as claimed in claim 1 wherein:

the musical instrument is a guitar;

the fingerboard is mounted on an elongate neck;

frets are formed transversely on the neck;

elongate structures corresponding to guitar strings are configured on the neck; and a first layer, second layer and spacer member are formed below each of the elongate structures.

5. An electronic musical instrument as claimed in claim 4 wherein the elongates structures corresponding to guitar strings comprise linear raised ribs on the on the fingerboard.

6. An electronic musical instrument as claimed in claim 4 wherein the frets are spaced from each other based on the preferences of the user, the electronic fingerboard being suitably programmed to play the note with the correct pitch based on the preferred spacing between the frets.

7. An electronic musical instrument as claimed in claim 4 wherein each elongate structure corresponding to the strings has first and second layers of film comprised of electrodes.

8. An electronic musical instrument as claimed in claim 1 wherein the first layer is a conductive strip, and the second layer is a resistive strip.

9. An electronic musical instrument as claimed in claim 8 wherein the conductive strip is comprised of silver ink with carbon overlay for durability and the resistive strip is comprised of carbon.

10. An electronic musical instrument as claimed in claim 9 wherein the conductive strip is on top, the resistive strip is below the conductive strip and the spacer member is formed therebetween.

11. An electronic musical instrument as claimed in claim 8 wherein the conductive strip is comprised of two electrodes which interlock with each other.

12. An electronic musical instrument as claimed in claim 1 wherein quantized mode, legato mode, or absolute mode is utilized to determine the pitch of the note.

13. An electronic musical instrument as claimed in claim 1 wherein user selected point provides a controllable resistance representing pitch of the note according to the location of the point on the fingerboard.

14. An electronic musical instrument as claimed in claim 1 wherein the onset signal sensor is triggered by plucking a string on the musical instrument.

15. An electronic musical instrument as claimed in claim 1 further comprising a microprocessor for sequentially reading and processing signals from the signal sensor and the electronic fingerboard respectively to determine when a note is played, as well as the volume and pitch of the note.

16. An electronic musical instrument as claimed in claim 15 wherein the microprocessor sends data on the note played to a MIDI interface.

17. An electronic musical instrument as claimed in claim 15 wherein the microprocessor sends data on the note played to an internal wavetable synthesizer.

18. An electronic musical instrument as claimed in claim 1 wherein the first and second layers have a terminal at one end thereof and voltage at the terminal is determined by the user selected point.

19. An electronic musical instrument as claimed in claim 18 wherein the voltage at the terminal is proportional to the user selected point along the first and second layers, at which point the first and second layers are shorted together.

20. An electronic musical instrument as claimed in claim 1 wherein first and second layers comprise a force sensing resistor whereby the resistance varies as pressure on the user selected point changes, the higher the pressure on the user selected point causing more area contact between the first and second layers.

21. An electronic musical instrument as claimed in claim 1 wherein the spacer member holds the first and second layers together but in a spaced apart relationship while permitting the first and second layer to contact each other upon application of pressure.

22. An electronic musical instrument as claimed in claim 1 wherein measurement of a played note is repeated a programmed number of times to determine an accurate pitch of played note.

23. An electronic musical instrument as claimed in claim 1 wherein the fingerboard comprises multiple conductive electrode planes, each plane for detecting the pitch of a note at one or more predetermined locations on the fingerboard.

24. An electronic musical instrument as claimed in claim 23 comprising two alternating electrode planes, each of the two planes being responsive to the user selected point when located at alternating frets of the fingerboard.

25. An electronic musical instrument for producing musical notes comprising:

an electronic fingerboard having longitudinal strings and transverse frets formed by linear raised rib surfaces to provide tactile feedback and feel similar to a conventional stringed instrument, the electronic fingerboard determining pitch of the note, the electronic fingerboard comprising a first layer of film, a second separate layer of film and a spacer member between the first and second layers of film, the first and second layers being movable relative to each other between a first inactive position in which the first and second layers are separate from each other along their respective lengths and a second active position in which the first and second layers are in contact with each other at a user selected point along their respective lengths, the pitch being determined by the resistance between the first and second layers at the user selected point.

* * * * *